US006072977A

United States Patent [19]

Murakami

[11] Patent Number: 6,072,977

[45] Date of Patent: Jun. 6, 2000

[54] EVEN BIAS APPLYING TRANSFER ROLLER

[75] Inventor: Eisaku Murakami, Hiratsuka, Japan

[73] Assignee: Ricoh Company, Ltd., Tokyo, Japan

[21] Appl. No.: 09/236,635

[22] Filed: Jan. 26, 1999

[30] Foreign Application Priority Data

Jan. 26, 1998 [JP] Japan ..... 10-012242

[51] Int. Cl.[7] ..... G03G 15/16

[52] U.S. Cl. ..... 399/313; 399/314

[58] Field of Search ..... 399/310, 313, 399/314; 430/126

[56] References Cited

U.S. PATENT DOCUMENTS

| | | | |
|---|---|---|---|
| 3,942,888 | 3/1976 | Maksymiak et al. | 399/313 |
| 3,984,183 | 10/1976 | Maksymiak | 399/313 |
| 5,168,313 | 12/1992 | Hosaka et al. | 399/313 |
| 5,768,665 | 6/1998 | Yamanaka et al. . | |

FOREIGN PATENT DOCUMENTS

| | | |
|---|---|---|
| 7-199689 | 8/1995 | Japan . |
| 8-305182 | 11/1996 | Japan . |
| 9-236967 | 9/1997 | Japan . |
| 9-292784 | 11/1997 | Japan . |

*Primary Examiner*—Joan Pendegrass
*Attorney, Agent, or Firm*—Oblon, Spivak, McClelland, Maier & Neustadt, P.C.

[57] ABSTRACT

An image forming apparatus includes a photo-conductive member that carries a toner image on its surface and a transfer roller that pressure contacts the surface to transfer the toner image to a sheet. The transfer roller includes a bias-applying axis and an elastic layer engaged with a surface of the bias-applying axis. The image forming apparatus further includes a bias-applying device that applies a bias voltage to the bias applying axis. The elastic layer or the bias-applying axis has end portions and a middle portion between the end portions. The end portions have diameters greater than the middle portion.

4 Claims, 8 Drawing Sheets

EVEN BIAS APPLYING TRANSFER ROLLER

BACKGROUND OF THE INVENTION

1. Field of the Invention

This invention relates to a transfer roller for an image forming apparatus such as a copier, a facsimile, a printer, and/or a hybrid machine having a plurality of functions including functions of an image forming apparatus, and in particular, relates to a transfer roller having an elastic layer of even resistance along a width thereof and capable of evenly applying a bias voltage when a transfer process is executed.

2. Discussion of the Related Art

In a prior image forming apparatus, a transfer roller of relatively low quality is generally employed to transfer a toner image obtained by developing a latent image formed on a surface of a photo-conductive member to a sheet.

The prior transfer roller generally includes a metal core axis and an elastic layer having an electrically conductive powder blended therein, which is engaged with a circumference of the metal core axis. The prior transfer roller generally transfers the toner image onto a sheet while a bias voltage having a prescribed amount of potential related to the toner image is applied to the transfer roller. Since the elastic layer has the conductive powder, it may have an amount of resistance of a middle range. The resistance of the elastic layer is generally about $10_8$ ohms, considering efficiency of a toner transfer process.

When measuring the resistance of the elastic layer, the inventor of the present invention discovered the phenomenon described below.

When bias voltage is applied, electrical current flowing from a point on the surface of the metal core axis does not reach the closest point on the outer surface of the elastic layer. This occurs because the electrical current may disperse into the elastic layer, thereby increasing the number of electrical current paths. The increase in the number of electrical current paths may not be suppressed around a middle position of the width of the transfer roller.

However, the number of electrical current paths is suppressed around both edge portions of the transfer roller since the increase may only be allowed in an inner side direction at around both the edge portions. As a result, it is more difficult for the bias current to flow around both edges more than it is around the middle position of the width of the transfer roller. Accordingly, high resistance exists around both the edge portions.

A graph showing the results of a test measuring the resistance of the elastic layer of the prior transfer roller is illustrated in FIG. 8. The vertical axis of the graph shows the amount of resistance. The horizontal axis shows the distance from the edge of the elastic layer of the transfer roller. As illustrated in the graph, the amount of current flowing from the middle portion of the distance is almost even. The amount of the current flowing from both side portions, with each side portion ranging from about three or four centimeters from each edge of the elastic layer, is sharply increased.

Thus, when bias voltage is applied to the prior transfer roller using a constant-current-applying controller and so on, it is difficult for the current to flow from each of the side edge portions due to its high impedance and it is easy for the current to flow largely from the middle portion due to its low impedance. As a result, toner transfer efficiency is lowered at both the sides and is increased at the middle portion of the transfer roller, thereby resulting in an unevenness of the density of the toner image on the sheet.

SUMMARY OF THE INVENTION

Accordingly, it is an object of the invention to provide an image forming apparatus having a transfer roller that pressure contacts a surface of a photo-conductive drum and evenly transfers a toner image from the surface under a bias voltage.

The transfer roller includes a bias applying axis and an elastic layer engaged with a surface of the bias applying axis. The elastic layer and/or the bias applying axis has a pair of large diameter portions at both of their respective edge portions so that the bias current evenly flows from the bias-applying axis to a circumference of the elastic layer.

In an embodiment of the present invention, the elastic layer includes electrically conductive powder which is dispersed in the elastic layer in such a manner that an average distance between particles of the powder is closer at both edge portions of the transfer roller than that at the middle portion of the transfer roller.

In another embodiment of the present invention, the large diameter portions of the elastic layer and the bias applying axis are each separately made from the elastic layer and the bias applying axis, respectively, and are engaged with surfaces of the elastic layer and surfaces of the bias applying axis at both edge portions, respectively.

In yet another embodiment of the present invention, the large diameter portions are each tapered so that their diameter gradually increases in a direction of an edge of the transfer roller so that the variance of the bias current along the width of the transfer roller is reduced.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 7:
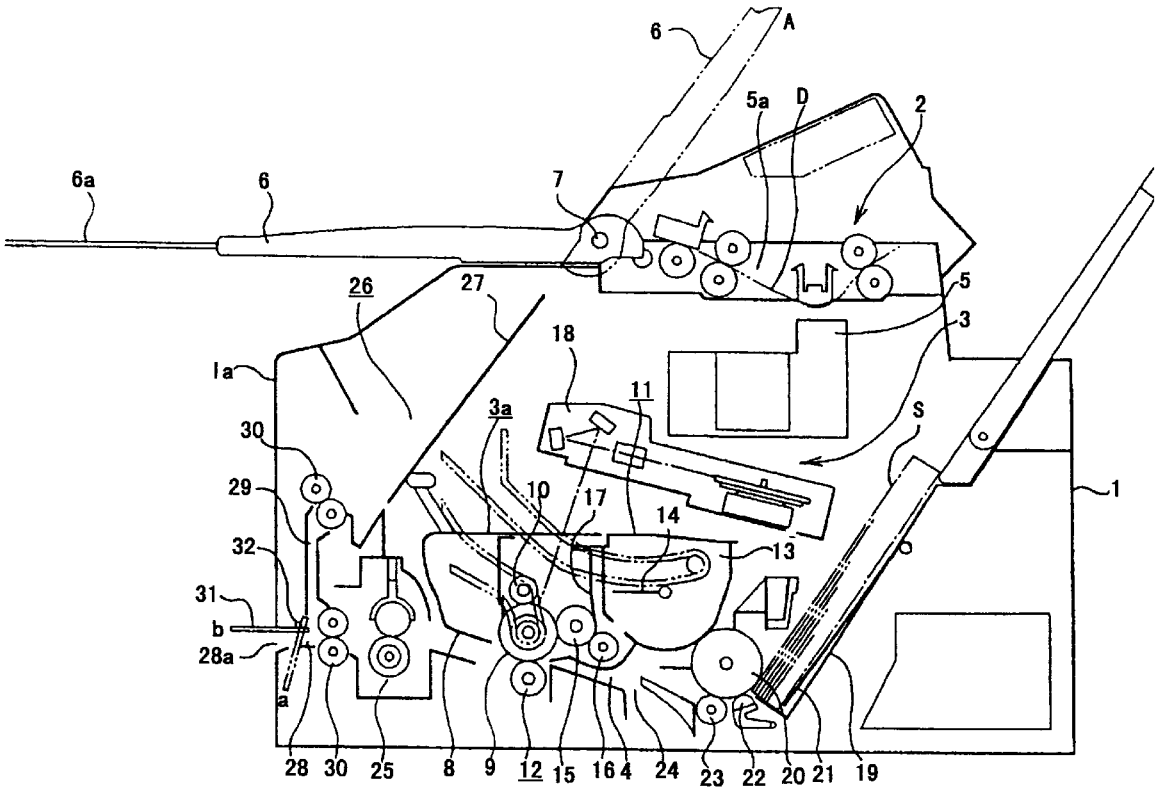
FIG. 7 is a cross sectional view that illustrates a printer to which the present invention is applied.
Figure 8:
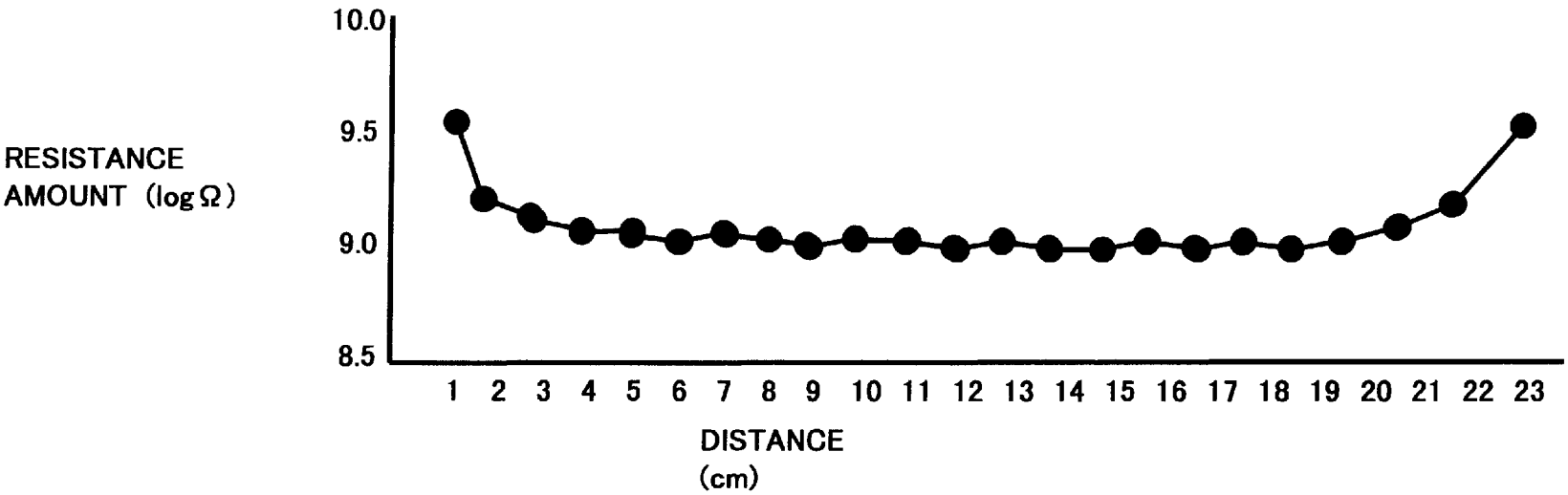
FIG. 8 is a graph that illustrates a change in electrical resistance of an elastic layer of the prior transfer roller along a widthwise direction of the transfer roller.

Referring now to the drawings, wherein like reference numerals designate identical or corresponding parts throughout the several views, and more particularly to FIG. 7 thereof, an image forming apparatus is shown. As illustrated in FIG. 7, the image forming apparatus includes a body 1 as an outer casing of the image forming apparatus, and an image reading device 2 disposed on the outer casing, which optically reads a document D.

The image forming apparatus further includes a printing device 3 disposed below the reading device 2, which makes a copy of the document D by printing an image on a sheet S. The printing device 3 includes a process cartridge 3*a* as a principal unit thereof. The image forming apparatus further includes a sheet transporting path 4 below the process cartridge 3*a*, which guides the sheet S downstream.

The image reading device 2 includes an image reading part 5 where the document D is read, and a document feeding mechanism 5*a* that feeds the document D toward the image reading part 5. A document setting table 6 on which the document D is set is mounted on a portion of the body 1.

The document setting table 6 is pivotally mounted by a supporting axis 7 to swing from an opening position illustrated by a dotted line to a document guiding position illustrated by a rigid line.

The document setting table 6 includes a supplementary tray 6a that may be freely drawn from the document setting table 6. A plurality of stoppers (not shown) are disposed in the body 1 to support the document setting tray 6 at the opening position and the document setting position respectively.

The process cartridge 3*a* includes a unit body 8 formed in a casing. A photo-conductive drum (hereinafter referred to as a PC drum) 9 is mounted to rotate freely on the unit body 8. Both a discharge member 10 and a developing device 11 are disposed around the PC drum 9. A transfer roller 12 is disposed below the PC drum 9 and presses against the surface of the PC drum 9. The developing device 11 includes a developer container 13 connected to the unit body 8, an agitating member 14 that agitates developer contained in the developer container 13, and a developing roller 15 contacting the surface of the PC drum 9. The developing device 11 further includes a supplying roller 16 that supplies developer to the developing roller 15, and a blade member 17 contacting the developing roller 15. The printing device includes an optical device 18 disposed above the process cartridge 3*a*, which forms a latent image on the surface of the PC drum 9 by exposing the surface with a laser beam modulated by a modulator (not shown) based on an image signal generated by reading the document D.

A tray 19 that receives the document D read by the image reading device 2 and obliquely supports blank sheets thereon is disposed at a side of the body 1.

A feeding roller 20 is disposed at a lowest level of the tray 19. A pressure plate 21 is biased by a spring (not shown) against the feeding roller 20 so that the topmost sheet presses against the feeding roller 20.

A separation pad 22 is disposed beside the feeding roller 20, which may avoid occurrence of a double feed by elastically contacting the feeding roller 20. A pinch roller 23 is also disposed beside the feeding roller 20, which freely rotates and pushes the sheet S against the feeding roller 20.

The feeding roller 20, the separation pad 22, and the pinch roller 23 are disposed at an inlet side of the sheet-transporting path 4. A bottom path 24 disposed downstream of the feeding roller 20 is connected to the sheet transporting path 4. A fixing device 25 that may permanently fix the toner image on the sheet S is disposed downstream of the process cartridge 3*a*.

An opening-closing cover 1*a* is provided in the body 1. The opening-closing cover 1*a* includes a sheet stacker 26 disposed between the fixing device 25 and the document setting tray 6. The sheet stacker 26 includes a sheet receiving plate 27 which extends from the document tray 6 positioned at the opening position A illustrated by a dotted line to cooperatively support a relatively larger sheet thereon. The opening/closing cover 1*a* does not cover the sheet stacker 26.

The printing device 3 further includes a straight ejection path 28 which elongates from the fixing device 25 to a lower edge portion of the opening/closing cover 1*a* to eject the sheet S straight in a horizontal direction. A sheet inverting ejection path 29 is connected to the straight ejection path 28 at a portion of the path 29 between the fixing device 25 and the lower edge portion of the opening/closing cover 1*a*.

The sheet inverting ejection path 29 inverts the sheet S ejected from the fixing device 25 and guides it to the sheet stacker 26. A pair of ejection rollers 30 is each disposed below and above the sheet inverting ejection path 29, respectively. A switching plate 31 is pivotally mounted on a supporting axis 32 to freely swing from a position (a) (illustrated by a dotted line) to a position (b) (illustrated by a rigid line). The switching plate 31 is configured to be positioned at either position (a) or (b) corresponding to a swinging operation of the document setting tray 6. An ejection outlet 28*a* is disposed at an end of the straight ejection path 28.

Hereinbelow, image formation and print operations are explained. When reading the document D, the document setting tray 6 is positioned horizontally as illustrated by the rigid line illustrated in FIG. 7. The document D is set on the document setting tray 6 and is fed toward the document reading portion 5 by the document feeding mechanism 5*a*. The switching plate 31 correspondingly moves its position to the position (b) to guide the sheet S straight toward the sheet ejection outlet 28*a*. The document D is then read by the document reading device 5 and is then ejected.

When printing, the surface of the PC drum 9 is discharged during its rotation clockwise by the discharge device 10. The surface is then exposed using the optical device 18 based on an image signal sent from outside the image forming apparatus to form a latent image corresponding to the document image thereon. The developing roller 15 then develops the latent image. The toner image is then transferred onto the sheet S fed from the tray 19 at a transfer station. The toner image on the sheet S is then fixed onto the sheet S by the fixing device 25 when the sheet S passes through the fixing device 25. The sheet S is then ejected from the body 1 through the sheet ejection outlet 28*a*, guided by the straight ejection path 28, since the switching plate 31 is in the horizontal position.

When in a printing mode (except for a copy mode described above), reading of the document D is not required. Thus, the document-setting tray 6 is located at the position A. The switching plate 31 correspondingly swings to intersect the straight sheet ejection path 28. Thus, the sheet S ejected from the fixing device 25 is guided by the sheet switching plate 31 toward the inverting injection path 29. The sheet S is finally stacked on the sheet stacker 26.

Figure 1:
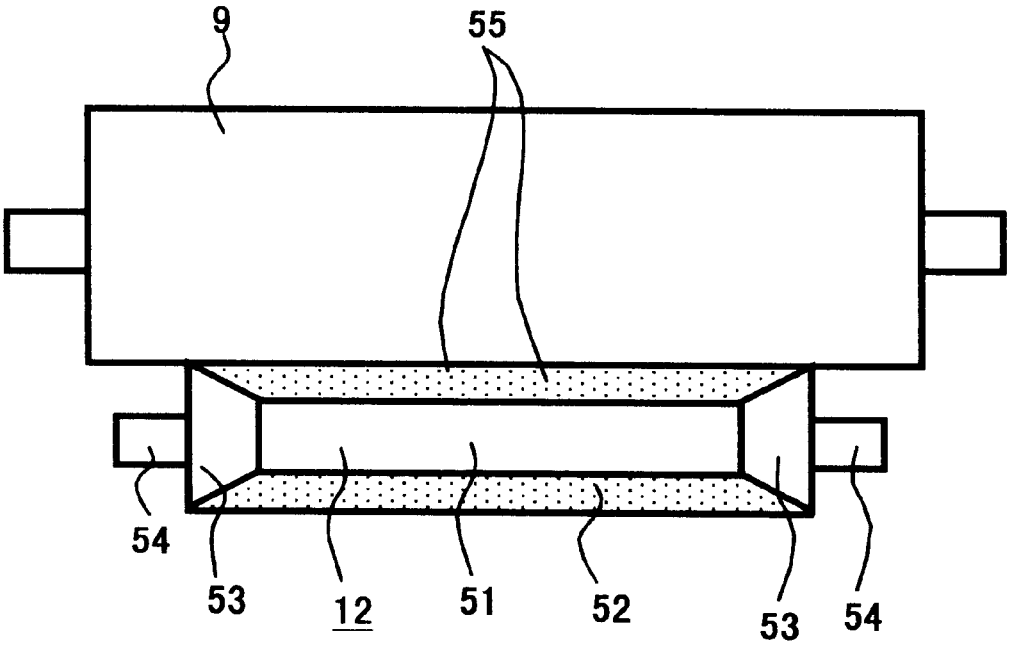
FIG. 1 is a side cross sectional view of one example of the present invention, which illustrates a photo-conductive drum and a transfer roller including a bias applying axis having a pair of large diameter portions at both of its side portions.

As illustrated in FIG. 1, the transfer roller 12 includes a bias-applying axis 51 made of material having a high electrical conductivity (such as metal) and an elastic layer 52 engaged with an outer circumference of the bias-applying axis 51.

The bias-applying axis 51 is configured to have a pair of large diameter portions 53 disposed at each side, which are larger in diameter than the middle portion. The large diameter portions 53 are each tapered so that each gradually increases its diameter in a direction of a supporting portion 54 of the bias-applying axis 51. Thus, the large diameter portions 53 have trapezoidal cross sections and are arranged on an internal surface of the elastic layer 52 at the edge portions thereof.

The elastic layer 52 includes basic material such as rubber and powder 55 having an electrically conductive character, such as carbon, which is blended in the basic material. Since the elastic layer 52 includes the carbon, it has a resistance of almost a middle range (i.e., a mid-level or moderate resistance). The elastic layer 52 has a constant diameter along its widthwise direction. Since the elastic layer 52 is engaged with the outer circumference of the bias-applying axis 51, the elastic layer 52 is thinner at its two edges than at its middle portion by an amount of a difference between the diameters.

When fitting the transfer roller 12 to the image forming apparatus, each of the supporting portions 54 is supported by a bearing (not shown) secured to a body of the image forming apparatus in such a manner that the elastic layer presses against the surface of the PC drum 9.

When the transfer roller 12 transfers the toner image carried on the surface of the PC drum 9 to the sheet, a prescribed amount of transfer bias voltage is applied to one of the supporting portions 54. The amount of resistance of each edge portion of the transfer roller 12 is not higher than that of the middle portion of the transfer roller 12.

This occurs because the ratio of a section area of the bias-applying axis 51 to the elastic layer 52 is larger at both edges of the transfer roller 12 than that at its middle portion. Accordingly the elastic layer 52 having a mid-level resistance is thinner at both the edges than at the middle portion.

As a result, the efficiency of the toner transfer is almost the same at both the middle portion of the transfer roller 12 and the edges of the transfer roller 12. Thus, the quality of a printed image is improved, even if a relatively large sheet that may pass through both side edges of the elastic layer 52 is used.

Figure 2:
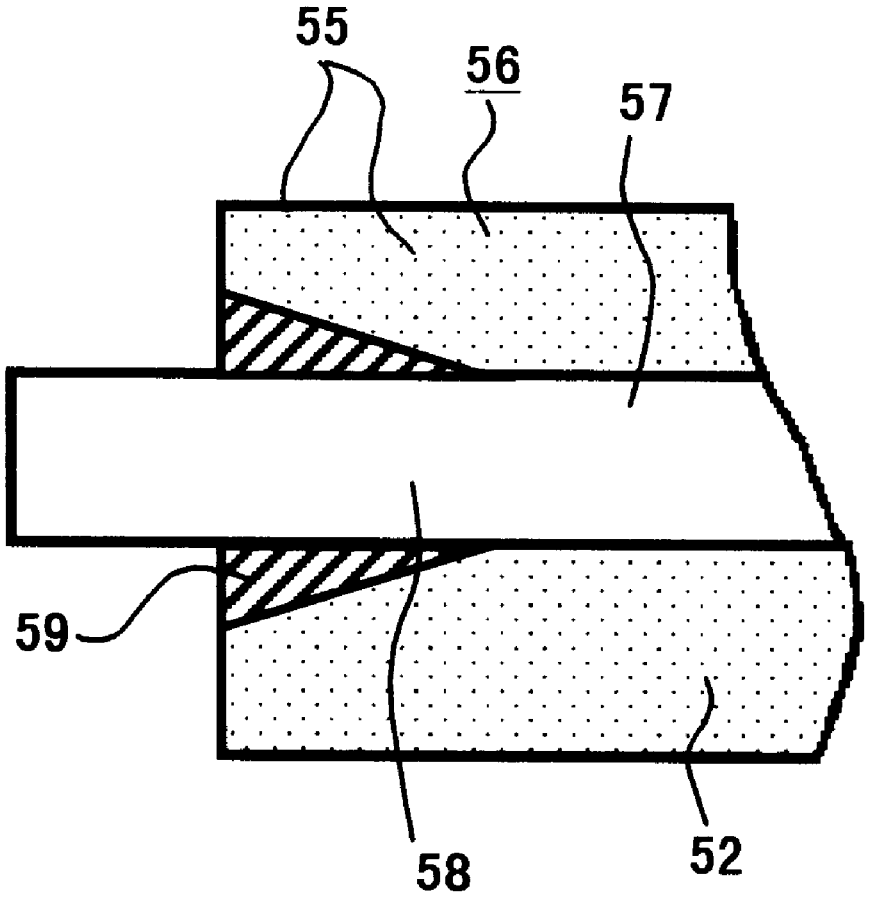
FIG. 2 is a partial cross sectional view of another example of the present invention, which illustrates a transfer roller including a bias-applying axis having a pair of large diameter portions at both of its side portions, which is separately manufactured from the bias-applying axis and is engaged with the surfaces of the bias-applying axis at both of its respective sides.
Figure 3:
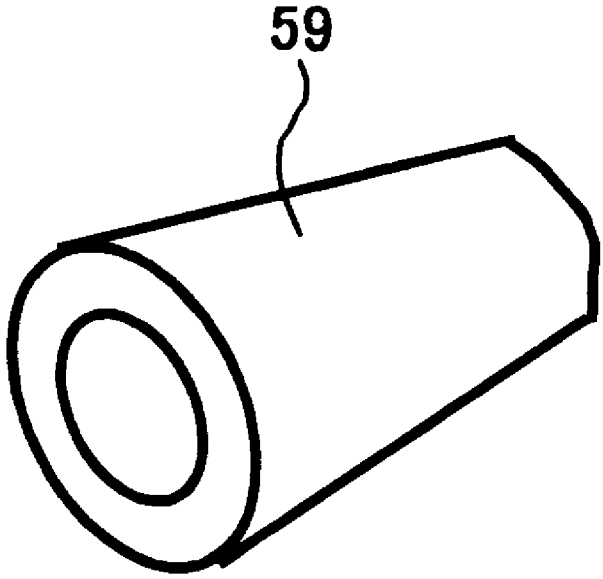
FIG. 3 is a perspective view that illustrates the large diameter portion of FIG. 2.

Hereinbelow, another example of a transfer roller is explained referring to FIGS. 2 and 3. The transfer roller 56 of this example is almost the same as the above-mentioned transfer roller 12 except for the bias-applying axis 57. As illustrated in FIG. 2, the bias-applying axis 57 includes a bias-applying axis body 58 of a straight axis made of electrically conductive material. The bias-applying axis 57 further includes a pair of rings 59 as a large diameter portion, each of which is made of an electrically conductive material such as powder 55 and engaged with an outer circumference of the bias-applying axis body 58 at both edge portions of the elastic layer 52. In other words, the two large diameter portions are the pair of rings 59 with triangular cross sections and are arranged on an internal surface of the elastic layer 52 at the edge portions thereof. Thus, the efficiency of the toner transfer is similar to that of the above-mentioned example.

Further, since the bias-applying axis body 58 is made straight, it may be manufactured only using a push-out molding method. Thus, a cutting process that may be generally applied to the bias-applying axis body 58 after its molding to increase its precision may be omitted. Since a cutting process is quickly completed in a case of molding a straight axis, even if the cutting process is applied to the bias-applying axis body 58 after its molding, the manufacturing cost is reduced. Accordingly, the manufacturing time may be minimized and material for the bias-applying axis body 58 may be saved. The ring 59 shown in FIG. 3 may also be manufactured by cutting material such as metal, plastic and so on. When molding the ring 59, plastic having electrical conductivity may be used.

Figure 4:
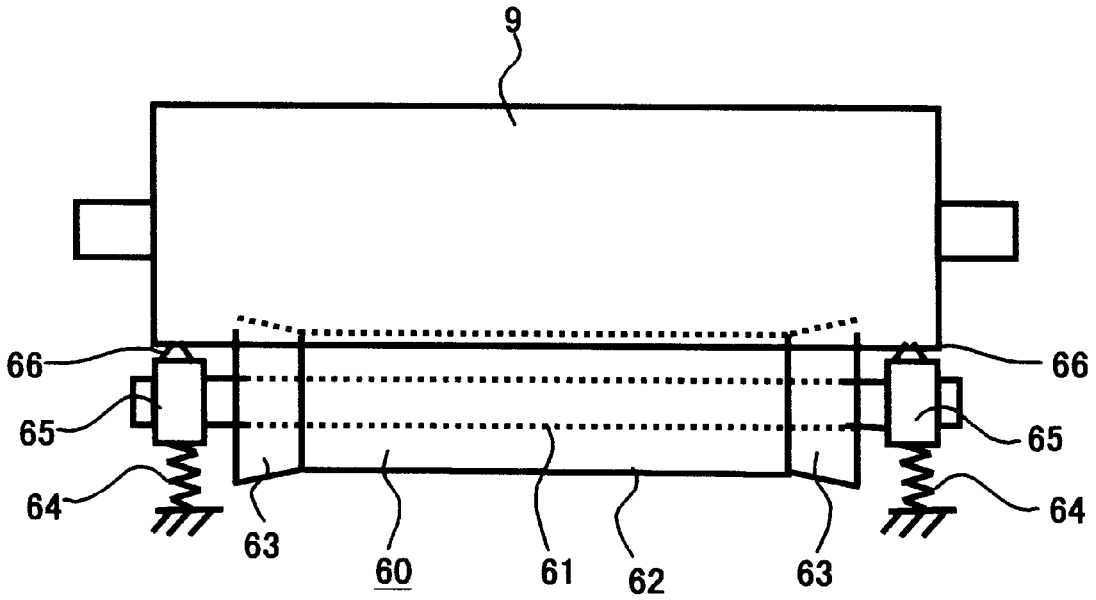
FIG. 4 is a cross sectional view that illustrates another example of a transfer roller that has an elastic layer having a pair of large diameter portions at both of its side edges.

Hereinbelow, another example of the transfer roller is explained referring to FIG. 4. As illustrated in FIG. 4, a transfer roller 60 includes a bias-applying axis 61 made of an electrically conductive material such as metal, and an elastic layer 62 engaged with an outer circumference of the bias-applying axis 61. The elastic layer 62 includes a basic material, such as rubber, and an electrically conductive powder, such as carbon, which is blended to the basic material in the same manner as mentioned earlier. Thus, the elastic layer 62 has a moderate or mid-level resistance.

Further, the elastic layer 62 includes a pair of large diameter portions 63 at both of its edges. The large diameter portions 63 are tapered. Also, the large diameter portions 63 each have a trapezoidal cross section and are arranged at ends of the edge portions of the elastic layer 62.

To fit the transfer roller 60 into the body of the image forming apparatus, a pair of bearings 65 is employed. Each of the bearings 65 rotationally supports a side edge of the bias-applying axis 61. The bearings 65 are biased by a pair of springs 64, respectively, toward a surface of a PC drum 9. To adjust the amount of deformation of the surface of the elastic layer 62 when the transfer roller 60 presses against the surface of the PC drum 9, a pair of spacers 66 is secured on the bearings 65, respectively. Since bias is applied to each of the spacers 66 by each of the springs 64, respectively, the pair of spacers 66 presses against the surface of the PC drum 9. The spacers 66 contact portions the surface of the PC drum 9 in which image formation is not executed. Thus, the spacers 66 determine the amount of the deformation of the surface of the elastic layer 62 when each contacts the surface of the PC drum 9.

When printing, a prescribed amount of transfer bias voltage is applied to one of the axis supporting portions of the bias-applying axis 61 to transfer a toner image carried on the surface of the PC drum 9 to a sheet passing through a transfer station.

Since the large diameter portions 63 are respectively disposed at each of the side edges of the transfer roller 60, each of the side edges of the elastic layer 62 is more strongly depressed by the surface of the PC drum 9 than its middle portion. Accordingly, each of the side edges is deformed more than the middle portion of the elastic layer 62. The typical amount of the deformation of the elastic layer 62 is illustrated by a dotted line in the PC drum 9 in FIG. 4. Thus, the average distance between the electrically conductive powder blended in the elastic layer 62 is smaller at the side edges than at the middle portion by an amount corresponding to an amount of surplus deformation at both side edges. Thus, it is not more difficult for bias current to flow from the bias-applying axis 61 to the outer surface of the elastic layer 62 at the side edges of the elastic layer 62 than it is at the middle portion. Thus, even if a toner transfer is performed in a state that a sheet S is fed with both side edges being set on corresponding side edges of the transfer roller 60, the efficiency of the toner transfer is almost the same at both side edges, as at the middle portion of the sheet S.

Since each of the large diameter portions 63 is tapered (i.e., gradually increasing its diameter toward respective side edges of the elastic layer 62), a difference in resistance level is not formed at the border between the large diameter portions 63 and the middle portion of the elastic layer 62 when the elastic layer 62 presses against the surface of the PC drum 9. As a result, the sheet S may be supported flatly from both sides thereof by the PC drum 9 and the transfer roller 60. Further, the amount of resistance of the elastic layer 62 does not vary sharply between the large diameter portions 63 and the middle portion thereof.

Figure 5:
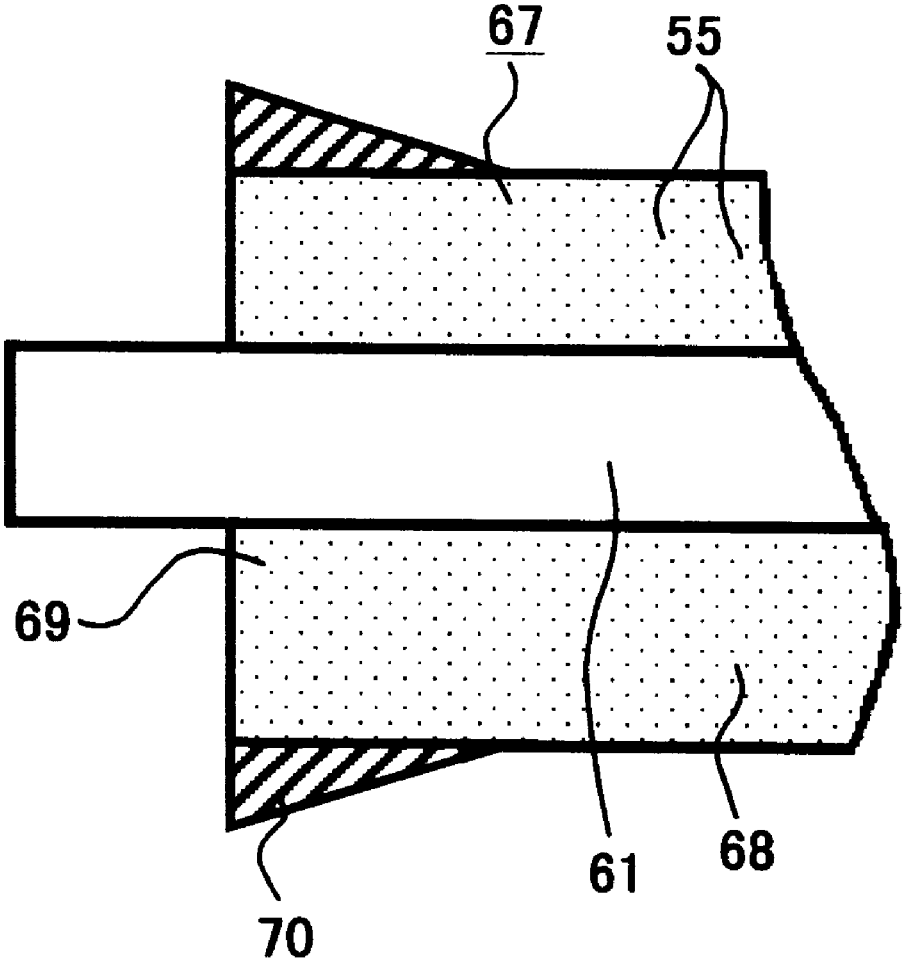
FIG. 5 is a partial cross sectional view that illustrates a pair of large diameter portions at both side edges, which are separately manufactured from an elastic layer of the transfer roller.

Another example of a transfer roller will now be explained referring to FIGS. 5 and 6. A transfer roller 67 of this example includes a bias-applying axis 61 similar to the bias-applying axis 61 illustrated in FIG. 4. The transfer roller 67 further includes an elastic layer 68 engaged with an outer circumference of the bias-applying axis 61. The elastic layer 68 is constructed similar to the elastic layer 62 illustrated in FIG. 4 except for a pair of rings 70. The elastic layer 68 in FIG. 5 is made of rubber or the like and electrically conductive powder 55 which is blended in the rubber. As illustrated in FIG. 5, each of the rings 70 as a large diameter portion engaged with respective circumferences of side edge portions 69 of the elastic layer 68. Thus, the two large diameter portions are the pair of rings 70 with triangular cross sections and are arranged on an external surface of the elastic layer 68 of the edge portions 69.

Figure 6:
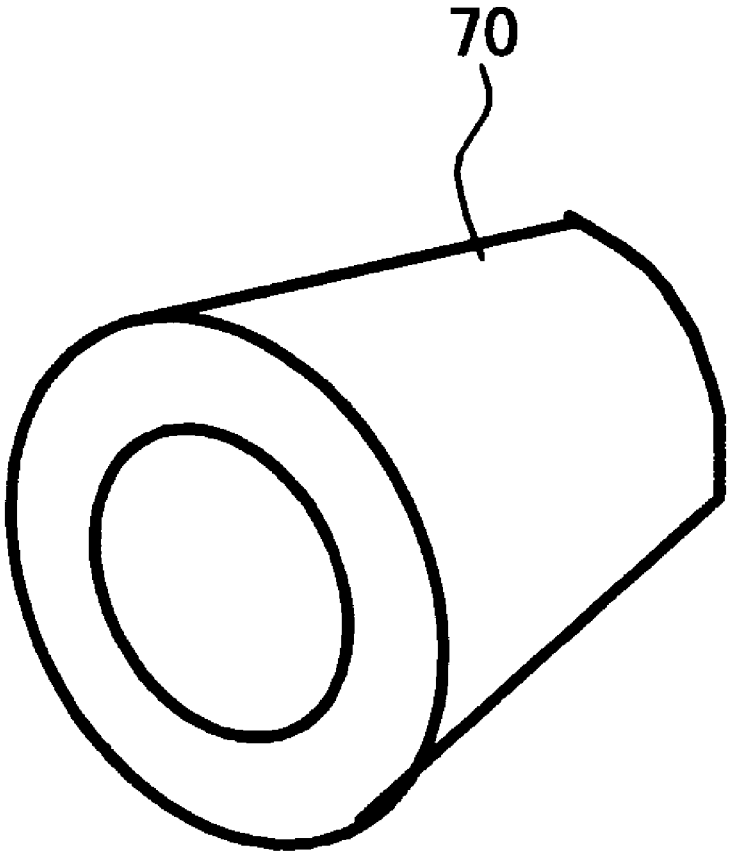
FIG. 6 is a perspective view of the large diameter portion illustrated in FIG. 5.

The rings 70 in FIG. 6 are made of elastic material, for example, and electrically conductive powder which is blended in the elastic material in such a manner that the rings 70 have an electrical resistance equal to or smaller than the elastic layer 67.

The efficiency of toner transfer with the transfer roller 67 described in conjunction with FIG. 5 is similar to that obtained with the transfer rollers described in conjunction with FIGS. 1–4. Further, since the rings 70 are manufactured separately from the elastic layer 68, the elastic layer 68 may be obtained for example, by cutting a tubular elastic member in a prescribed length.

A difference in the level of resistance is not formed at the border between the elastic ring 70 and the middle portion of the elastic layer 68 for the same reason as mentioned earlier. Further, a sheet S is supported flat from both of its sides by both the PC drum 9 and the transfer roller 67 for the same reason as mentioned earlier. Further, the electrical resistance of the transfer roller 67 does not sharply vary between the elastic ring 70 and the middle portion of the elastic layer 68 for the same reason as mentioned earlier.

Further, a modified transfer roller may be obtained using a molding method described below. For example, a plurality of molten elastic materials each including carbon therein in a different ratio, is prepared. The elastic material that includes carbon in a higher ratio is pored into a mold to enter into portions of the mold corresponding to both edge portions of the transfer roller. Another elastic material that includes carbon in a lower ratio is then poured into the mold to enter into a portion of the mold corresponding to the middle portion of the transfer roller. Since the distance between powders is shorter at both side edges of the elastic layer than at its middle portion, electrical resistance is not higher at the side edges than at its middle portion. Thus, the efficiency of toner transfer is almost the same at the side edges of the elastic layer as at its middle portion.

Obviously, numerous modifications and variations of the present invention are possible in light of the above teachings. It is therefore to be understood that, within the scope of the appended claims, the invention may be practiced otherwise than as specifically described herein.

The present application is based on Japanese Patent Application No. 10-12242 (filed Jan. 26, 1998), the contents of which are incorporated herein by reference.

What is claimed as new and desired to be secured by Letters Patent the United States is:

1. The image forming apparatus comprising:

a photo-conductive member configured to carry a toner image on a surface of the photo-conductive member;

a transfer roller configured to press against said surface of the photo-conductive member and transfer said toner image to a sheet, said transfer roller including a bias applying axis and an elastic layer engaged with a surface of the bias applying axis, said elastic layer having edge portions and a middle portion between the edge portions of the elastic layer; and a bias applying device configured to apply a bias voltage to said bias applying axis;

wherein said elastic layer is thicker at the two edge portions than at the middle portion;

wherein said elastic layer includes an electrically conductive powder dispersed and compressed therein such that an average distance between particles of the powder is smaller at the edge portions than at the middle portion;

wherein said bias-applying axis has a constant diameter along a width of the bias-applying axis;

said elastic layer includes two large diameter portions respectively located at the edge portions of the elastic layer and having diameters larger than a diameter of the middle portion; and wherein the diameters of the two large diameter portions increase toward respective edges of the transfer roller.

2. The image forming apparatus of claim 1, wherein said elastic layer comprises:

an elastic layer body having a constant diameter along a width of the elastic layer body, said two large diameter portions being made separately from the elastic layer body and being engaged with surfaces of the elastic layer body at the edge portions of the elastic layer, respectively.

3. The image forming apparatus of claim 2, wherein the two large diameter portions each have a trapezoidal cross section and are arranged at ends of the edge portions of the elastic layer.

4. The image forming apparatus of claim 2, wherein the two large diameter portions are a pair of rings with triangular cross sections and are arranged on an external surface of the elastic layer at the edge portions thereof.

* * * * *